US005791930A

United States Patent [19]

Tabata et al.

[11] Patent Number: 5,791,930

[45] Date of Patent: Aug. 11, 1998

[54] CONNECTOR FOR DETECTING INCOMPLETE ENGAGEMENT

[75] Inventors: Masaaki Tabata; Tetsuya Shinozaki, both of Yokkaichi, Japan

[73] Assignee: Sumitomo Wiring Systems, Ltd., Japan

[21] Appl. No.: 744,824

[22] Filed: Nov. 6, 1996

[30] Foreign Application Priority Data

Nov. 17, 1995 [JP] Japan ..... 7-323916

[51] Int. Cl.[6] ..... H01R 4/50

[52] U.S. Cl. ..... 439/345; 439/352

[58] Field of Search ..... 439/489, 490, 439/350–352, 140

[56] References Cited

U.S. PATENT DOCUMENTS

| | | | |
|---|---|---|---|
| 4,017,139 | 4/1977 | Nelson | 439/352 |
| 4,548,455 | 10/1985 | Ezure | 439/352 |
| 5,082,455 | 1/1992 | Wei | 439/352 |
| 5,178,552 | 1/1993 | Jinno et al. | 439/345 |
| 5,362,248 | 11/1994 | Hashiguchi et al. | 439/352 |
| 5,370,543 | 12/1994 | Hamada et al. | 439/188 |

FOREIGN PATENT DOCUMENTS

| | | |
|---|---|---|
| 4-306575 | 10/1992 | Japan . |
| 5-81967 | 11/1993 | Japan . |

*Primary Examiner*—Hien Vu
*Attorney, Agent, or Firm*—Banner & Witcoff, Ltd.

[57] ABSTRACT

One electrical connector 10 has no moving parts and the mating connector 20 has moving parts. This is made possible since connector locking projections 12 and detecting ribs 13, which serve as a first and second abutments respectively, are formed on the outer peripheral surface of one connector 10. The other connector 20, has a locking member 23 that fits with the locking projection 12, and a movable shutter 24 that overlies the locking member 23. The detecting rib 13, engages the shutter 24 which permits bending and thus latching of the locking member 23 only when the shutter 24 is to the retracted position. Once latched the shutter is movable to an advanced position to prevent the connectors being pulled apart.

17 Claims, 4 Drawing Sheets

CONNECTOR FOR DETECTING INCOMPLETE ENGAGEMENT

TECHNICAL FIELD

The present invention relates to a half-fitting detecting connector assembly wherein a pair of electrical connectors is arranged so as to not end up in a half-fitted state during connection thereof.

BACKGROUND TO THE INVENTION

An example of this kind of half-fitting detecting connector is described in Laid-Open Publication Jikkaihei 5-81967, and is shown in FIG. 14 hereof.

In FIG. 14 a male connector 1 is formed in a rectangular box shape and has a tubular hood 2 located at the anterior side thereof. The centres of both the side walls of the hood 2 have two parallel slits each, formed from the open side of the hood 2. Between these slits are formed flexible arms 3. The inner faces of the anterior ends of the arms 3 have wedge-shaped projections 3*a* formed thereon.

A female connector 4 is capable of being inserted into the hood 2. The female connector 4 has a terminal insertion member 5 having concave members 5*a* which allow the insertion therein of the projections 3*a*. A tubular cover 6 is attached so as to cover the exterior of the terminal insertion member 5. This cover 6 is movable in an anterior-posterior direction relative to the axial direction of the terminal insertion member 5. Furthermore, a clearance not exceeding the thickness of the hood 2 is provided between the cover 6 and the terminal insertion member 5. The cover 6 is pushed towards the fitting face side by means of a spring 7.

According to the configuration described above, when the terminal insertion member 5 is inserted into the hood 2, the wedge-shaped projections 3*a* mount the exterior periphery of the terminal insertion member 5, causing the bending arms 3 to project outwards and to extend beyond the clearance between the cover 6 and the terminal insertion member 5. For this reason, as the terminal insertion member 5 is inserted into the hood 2, an abutment takes place with the anterior end face of the cover 6, and the force of the spring 7 pushes the terminal insertion member 5 back.

Consequently, if the terminal insertion member 5 is released half-way through insertion, the cover 6 collides against the bending arms 3 and pushes outwards. On the other hand, if the terminal insertion member 5 is pushed right up to the correct fitting position in the hood 2, the projections 3*a* fit into the concave members 5*a*, and the flexible arms 3, which were projecting outwards, coincide with the plane face of the hood 2. When this happens, the cover 6 ceases to abut the bending arms 3, and the cover 6 passes by the arms 3 and moves to an anteriorly located position. As a result, when the cover 6 is released the flexible arms 3 are protected and latched securely. In order to release the lock, the cover 6 is pushed in the posterior direction, and the male connector 1 is removed with the flexible arms 3 in an exposed state. Thus this connector cannot inadvertently be placed in a half fitted state.

In the conventional half-fitting detecting connector described above, the flexible arms 3, which serve as movable members, are formed on the male connector 1, and the cover 6, which serves as a movable member, is formed on the female connector 4. However, since there are cases where a movable member on both the connectors cannot be formed, such a configuration poses a problem.

The present invention has been developed after taking into account the foregoing problem and aims at presenting a half-fitting detecting connector wherein at least one connector of a pair does not have a movable member.

SUMMARY OF THE INVENTION

According to the invention there is provided a half-fitting detecting connector assembly comprising a first connector having a housing with an open tubular portion, and a second connector engageable with said first connector and having a body insertable within said tubular portion, the body having first and second abutments and said first connector having a locking member extending in the direction of the axis of said tubular portion, the locking member having a resilient latch for engagement with said first abutment to releasably retain the second connector with the first connector, wherein the first connector has a shutter extending in the direction of the axis of the tubular portion and being movable away from the tubular portion against a resilient bias from an advanced to a retracted position, said shutter being engageable by the second abutment on insertion of the second connector in the first connector, said shutter permitting latching movement of said latch only in the retracted position, and said shutter preventing latching movement of said latch when in the advanced position.

Such a connector assembly has both movable parts provided on one connector thus simplifying the other connector. Thus a connector can be moulded integrally as part of a much larger component, for example a machine housing, without the need for movable connector parts; the movable parts are provided on the other connector thus reducing cost. Moreover a material suitable for movable parts need only be selected for one of the connectors. Furthermore damage to movable parts on one of the connectors is avoided; this is especially useful in the case where a connector is moulded as part of a machine housing which may itself be subjected to other assembly operations.

In essence the invention ensures that the shutter prevents engagement of the locking member unless in the retracted position. Furthermore the shutter moves to the advanced position after engagement of the locking member thus ensuring a positive secure latch which will not release until the shutter is once again in the retracted position.

Movement of the shutter to the retracted position against a resilient bias ensures that the engagement force exceeds the insertion force of individual terminals within the connector assembly. In turn this ensures that a sudden release of the resilient bias will avoid the possibility of a half fitted state

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is explained hereinbelow, with reference to diagrams.

Figure 1:
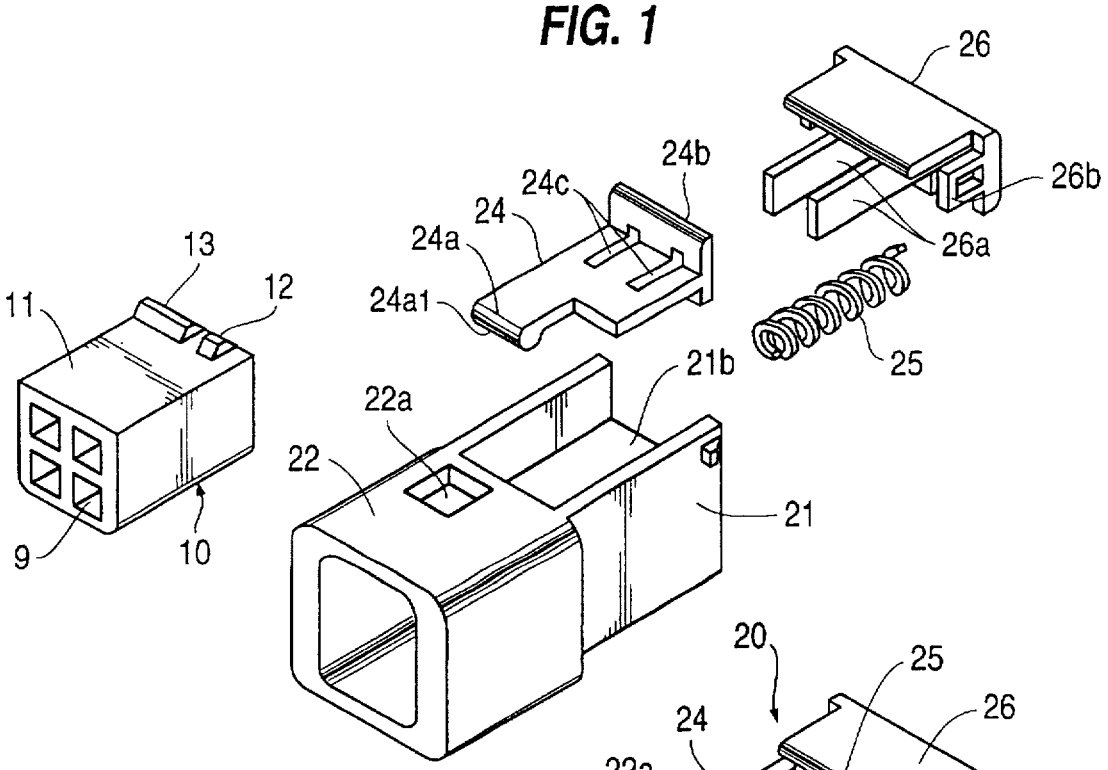
FIG. 1 is an exploded diagonal view of a half-fitting detecting connector relating to an embodiment of the present invention.
Figure 2:
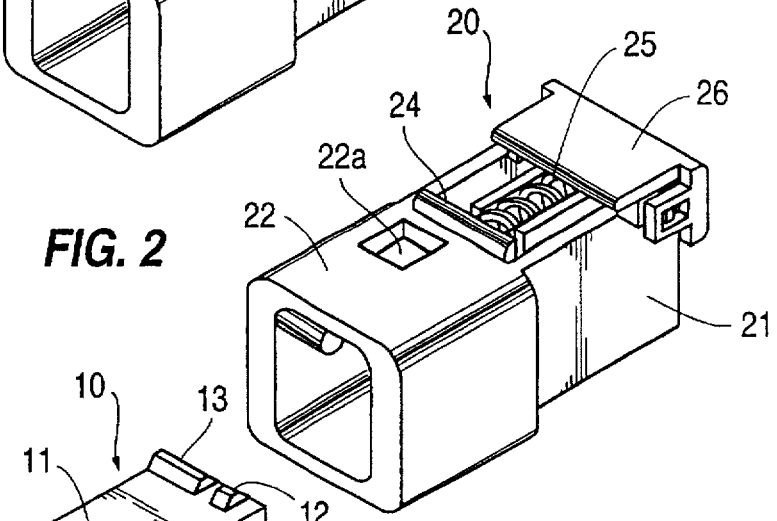
FIG. 2 is a diagonal view of the fitted state of the detecting connector of FIG. 1.
Figure 2:
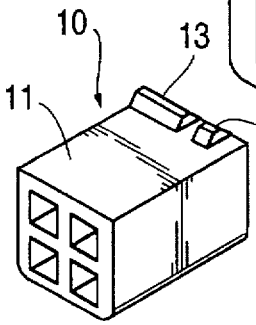
Figure 3:
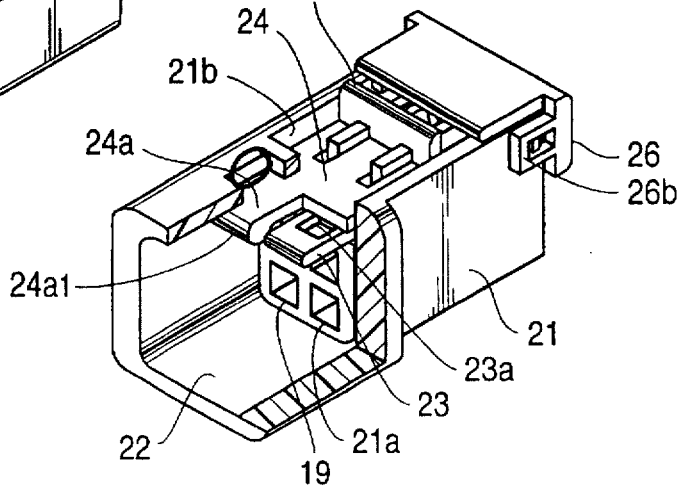
FIG. 3 is a partial cut-away diagonal view of the detecting connector of FIG. 1.

FIG. 1–3 show a half-fitting detecting connector according to the present invention. Terminals are omitted in all the drawings for reasons of clarity and only attachment portions of the housings are shown.

A female connector 10 is formed in a schematically rectangular shape and constitutes a first connector housing. A plurality of terminal insertion chambers 9 is formed in an axial direction of the housing; these allow the insertion of female terminals therein. A male connector housing 20, which serves as a second connector housing, comprises a terminal insertion member 21 having a plurality of terminal insertion chambers 19 formed in an axial direction of the housing which allow the insertion of male terminals therein, and a hood 22 that projects tubularly in an anterior direction from the periphery of a terminal fitting guiding face 21*a* located on the fitting face side of the terminal insertion member 21. The hood 22 of the male connector 20 allows the female connector 10 to be inserted therein, and is arranged to form a unified body after the female connector 10 is inserted, as will be described later.

The upper face of the female connector 10 has a narrow connector locking projection 12 that serves as a first abutment member, and a wide detecting rib 13 that serves as a second abutment member. These are formed in a linear manner in a direction that is perpendicular to the axial direction of the female connector 10. Although in the present embodiment the connector locking projection 12 and the detecting rib 13 are in line, this is not essential as long as they are arranged in a location whereby they face a locking member 23 and a shutter 24, to be described later, of the male connector 20. Consequently, the side faces and the lower face etc., that is, the so-called peripheral faces of the connector 10 may equally be used. Moreover, the arrangement may equally be varied in accordance with the timing, to be described later.

A concave recess 21*b* is formed on the upper face of the terminal insertion member 21 of the male connector 20. The concave recess 21*b* opens out towards the upper face and rear face of the terminal insertion member 21. A shutter 24 is inserted and attached into the concave recess 21*b* between the walls separating the terminal fitting guiding face 21*a*; a spring 25 is then attached on a posterior side thereof so as to push the shutter 24 in the direction of the fitting face side; and then a stopper or cap 26 is attached to the posterior face of the spring 25 so as to cover the posterior side of the concave recess 21*b*.

The shutter 24 at its posterior end has a width corresponding to that of the concave recess 21*b*. Its anterior end, however, projects partially so as to face only the detecting rib 13. A contact member 24*a* is formed by providing at the lower face of the anterior end a fitting projection 24*a*1 that is peak-shaped cross sectionally and that extends in a width-wise direction. Nevertheless, the detecting rib 13 only needs to be formed so as to face this contact member 24*a*. In the case where the detecting rib 13 is formed on the lower face of the second connector, necessary changes can be made. For example, the shutter 24 may be arranged to be located on the lower face, and the shape may be changed so that fitting projection 24*a*1 projects in a downward direction. The fitting projection 24*a*1 on the lower face of the contact member 24*a* is arranged to abut with the detecting rib 13. Accordingly, the portion posterior to the fitting projection 24*a*1 does not abut with the detecting rib 13 and effectively constitutes a second concave member. Of course, in accordance with the shape of the detecting rib 13, it is also possible to make the shutter 24 into a window shape so that it is open in a vertical direction.

The contact member 24*a* enters the interior of the hood 22 by passing through the separating wall of the terminal fitting guiding face 21*a*. The portion extending from the middle to the posterior of the shutter 24 is exposed via the concave recess 21*b*. The exposed portion has a pressing-down member 24*b* formed thereon so as to project upwards. Furthermore, two parallel slits 24*c* are formed in an anterior-posterior direction. Corresponding to these slits 24*c*, two plate-shaped guiding plate members 26*a* are formed on the stopper 26 so as to extend within the concave member 21*b* from a posterior direction to an anterior direction. The guiding plate members 26*a* enter the slits 24*c*, thereby allowing the shutter 24 to be movable in a straight line in an anterior-posterior direction. Moreover the spring 25 is placed between these two guiding plate members 26*a*, thereby having its movement in lateral and vertical directions controlled. Furthermore, the anterior and posterior portions of the spring 25 that make contact with the shutter 24 and the stopper 26 have small cylindrical-shaped projections 24*d* and 26*c* so as to prevent the spring 25 from getting dislodged. The stopper 26 is formed so as to partially cover the posterior and upper open ends of the concave recess 21*b*. The stopper 26 has locking members 26*b* that clamp from both sides the posterior-end side faces of the terminal insertion member 21. The locking members 26*b* are fixed in place by recesses formed on the anterior end of the locking members 26*b*, which fit with projections formed on the posterior-end side faces of the terminal insertion member 21.

In the present embodiment, the concave recess 21*b* is formed on the upper face of the terminal insertion member 21 located at the posterior end of the hood 22. The shutter 24 is arranged to be slidable within the concave recess 21*b*. However, the supporting configuration can be varied as necessary as long as the shutter 24 is supported within the hood 22 so as to be capable of advancing and retracting within the hood 22, and as long as the required movement can be carried out. Further, regarding the pushing force applied in the opening of the hood 22, the location, variety etc. of the spring 25 can be varied as necessary. In the present embodiment, by supporting the coil-shaped spring 25 with the guiding plate members 26*a*, the spring 25 does not move laterally and the shutter 24 can be made to move advance and retract correctly.

As described above, the anterior end of the shutter 24 has a portion projecting from one side so as to face only the detecting rib 13. The other side is cut away. A plate shaped locking member 23 is formed so as to face the connector locking projecting 12 on the inner side of the cut-away portion towards the terminal fitting guiding face 21*a*. The locking member 23 has a fitting hole 23*a* which serves as a first concave member. The fitting hole 23*a* is cut through the locking member 23 in a vertical direction and allows the fitting of the connector locking projection 12. Since this locking member 23 is located on an inner side with respect to the shutter 24, the shutter 24 is located between the inner wall faces of the locking member 23 and the hood 22. Further, although the locking member 23 is located on the inner side of the cut-away portion of the shutter 24, the locking member 23 can be placed in, two states. In one state the upper face of the locking member 23 is covered by the shutter 24 and in the other state the upper face of the locking member is open and faces the cut-away portion of the shutter 24.

When the upper face of the locking member 23 is open, the shutter 24 is located towards the inside of the connector. This state can be referred to as a retracted state, whereby the shutter 24 has been retracted from the upper face of the locking member 23. In the opposite advanced state whereby the upper face of the locking member 23 is covered, the locking member 23 cannot flex in an upward direction. However, in the open state the locking member can flex. When the locking member 23 is in a flexible state due to retraction of the shutter, the connector locking projection 12 pushes the locking member 23 upwards, enters under it and enters into the fitting hole 23*a*. However, in the state when the locking member 23 is in an unbendable position due to the shutter being advanced, it is impossible for the connector locking projection 12 to push the locking member 23 upwards, enter under it and to enter into the fitting hole 23*a*. In the case where fitting has already been effected, it is also impossible for the connector locking projection 12 to push the locking member 23 upwards, enter under it and to be released from its fitting and the fitting hole 23*a*, thereby making the release of the locking fitting secure.

In this way, by locating the locking member 23 on the inner side of the shutter 24, the shape and location of the locking member 23 can be varied in accordance with its relation with the shutter 24 as long as the bending movement of the locking member can be placed in a possible state and an impossible state in correspondence with the advancing and retracting of the shutter 24, and as long as the fitting with the connector locking projection 12 can be made possible and impossible. A window member 22*a* is formed on the hood 22 so as to face the contact member 24*a* when the shutter 24 is in a specified position. When the contact member 24*a* faces the window member 22*a*, the contact member 24*a* is movable so as to bend in the outer direction. During the range where the contact member 24*a* is not movable so as to bend in this manner, the detecting rib 13 cannot collide with the fitting projection 24*a*1 of the contact member 24*a* and thereby pass under it. However, when the contact member 24*a* is in a bendable state, the detecting rib 13 can pass under the fitting projection 24*a*1 of the contact member 24*a*.

The locations of window member 22*a* and of the cut-away portion along the contact member 24*a* of the shutter 24 correspond respectively so that when the contact member 24*a* and the locking member 23 become bendable at the same time. This results in the timing described below.

Figure 4:
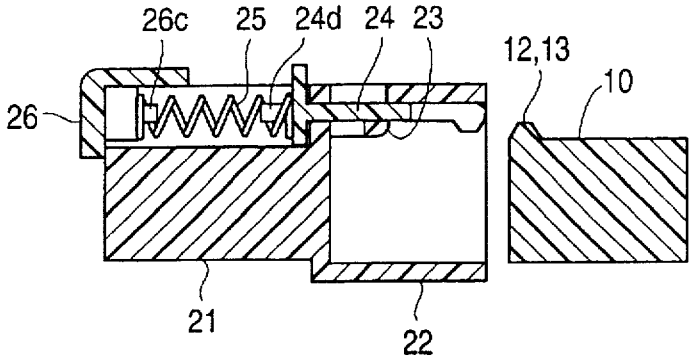
FIG. 4 is a cross-section in a vertical direction showing the stage prior to the start of the fitting operation.
Figure 5:
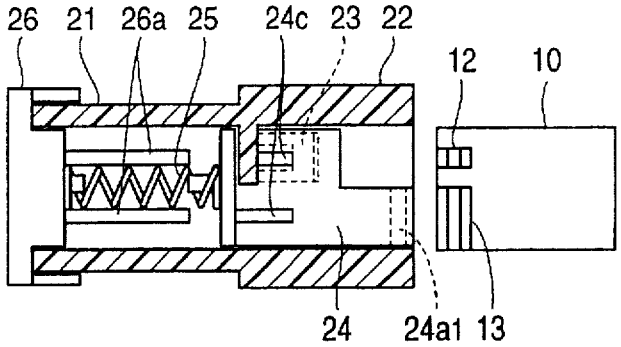
FIG. 5 is a cross-section in a horizontal direction showing the stage prior to the start of the fitting operation.
Figure 6:
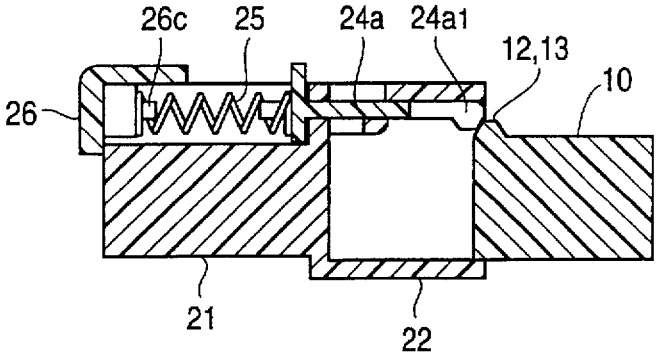
FIG. 6 is a cross-section in a vertical direction showing the start of the fitting operation.
Figure 7:
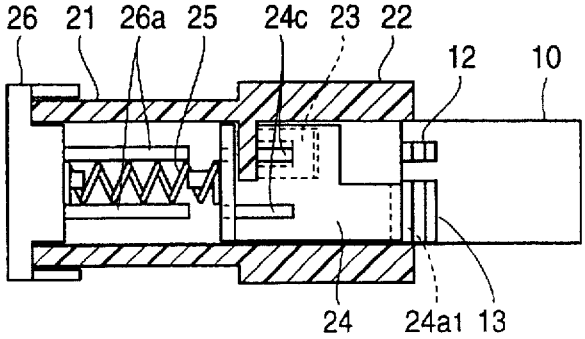
FIG. 7 is a cross-section in a horizontal direction showing the start of the fitting operation.
Figure 8:
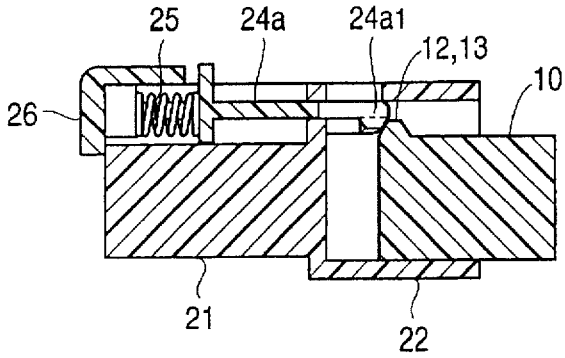
FIG. 8 is a cross-section in a vertical direction during the fitting operation.
Figure 9:
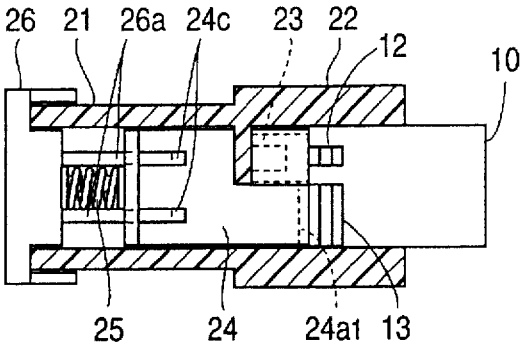
FIG. 9 is a cross-section in a horizontal direction during the fitting operation.

First, as shown in FIG. 4 and FIG. 5, the female connector 10 and the male connector 20 are made to face each other and the female connector 10 is inserted into the hood 22 of the male connector 20. As the insertion of the female connector 10 into the hood 22 begins, as shown in FIG. 6 and FIG. 7, the connector locking projection 12 collides with the fitting projection 24*a*1, which is located more towards the open end side than is the locking member 23. At this juncture, the contact member 24*a* is unbendable. Consequently, as shown in FIG. 8 and FIG. 9, as the female connector 10 is inserted, the shutter 24 is pressed and due to the opposing force of the spring 25 the female connector 10 is pushed outwards. Consequently, if the operator happens to interrupt the fitting operation during the half-fitted state, the female connector 10 is pushed out, and the half-fitted state is clearly detected and prevented.

Figure 10:
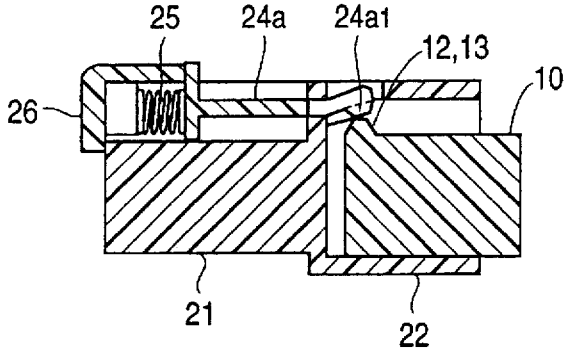
FIG. 10 is a cross-section in a vertical direction showing the state during the start of the retraction of the shutter.
Figure 11:
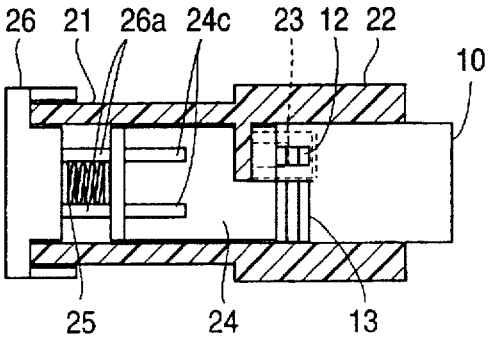
FIG. 11 is a cross-section in a horizontal direction showing the state during the start of the retraction of the shutter.

If the female connector 10 continues to be pressed in, the cut-away portion of the shutter 24 comes to be located above the upper face of the locking member 23 and the locking member 23 becomes flexible. However, at this juncture the connector locking projection 12 does not make contact with the locking member 23. Further, when the contact member 24*a* comes to face the window member 22*a*, as shown in FIG. 10 and FIG. 11, the connector locking projection 12 and the detecting rib 13 respectively collide with the contact member 24*a* and the locking member 23 and the contact member 24*a* begins to enter into the window member 22*a* by beginning to bend upwards. Along with this, the locking member 23 begins to enter into the cut-away portion of the shutter by beginning to bend upwards.

Figure 12:
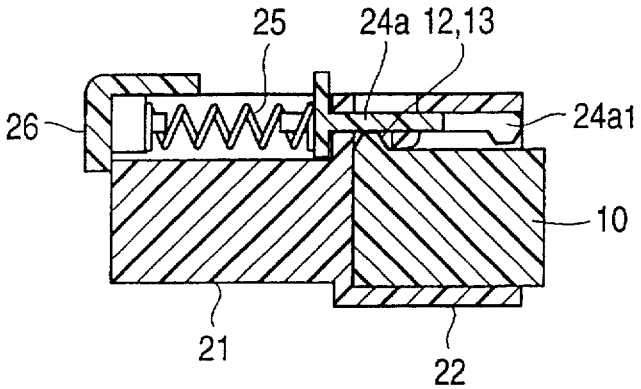
FIG. 12 is a cross-section in a vertical direction showing the state during the end of the fitting operation.
Figure 13:
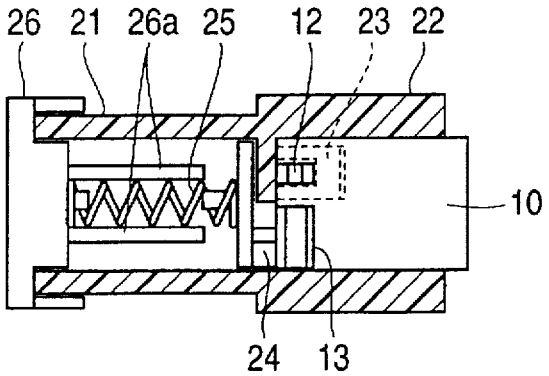
FIG. 13 is a cross-section in a horizontal direction showing the state during the end of the fitting operation.
Figure 14:
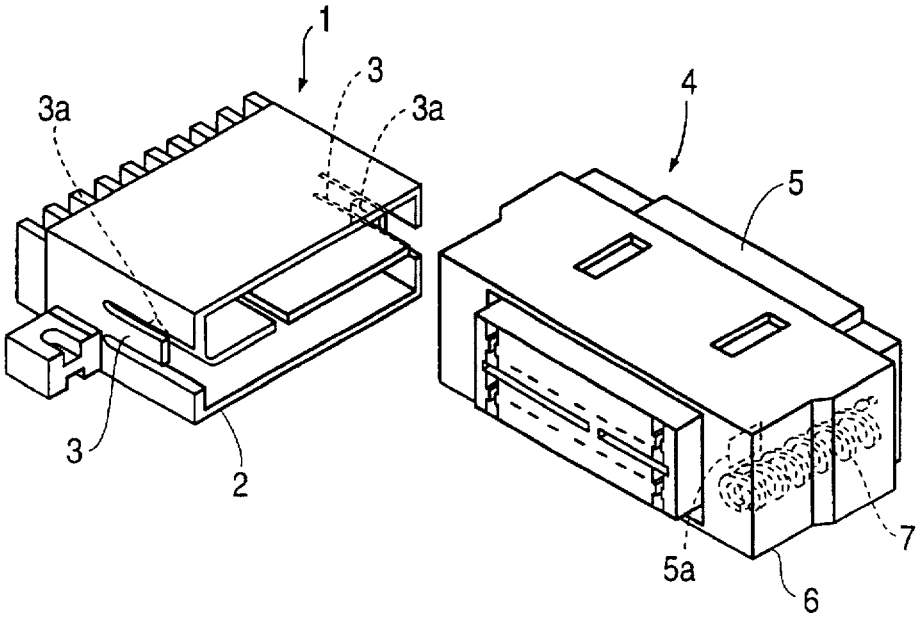
FIG. 14 PRIOR ART
FIG. 14 is a diagonal view of a conventional half-fitting detecting connector.

When the connector locking projection 12 passes under the locking member 23 and enters into the fitting hole 23*a*, the detecting rib 13 passes under the fitting projection 24*a*1 of the contact member 24*a*. Accordingly, the shutter 24 no longer has anything colliding against it and, as shown in FIG. 12 and FIG. 13, is pushed towards the open end by means of the elastic force of the spring 25. When the shutter 24 is pushed towards the open end the locking member 23 becomes unbendable since the shutter 24 covers the upper part of the locking member 23. As a consequence, the fitting with the connector locking projection 12 can no longer be released and a locked state is achieved.

Here, if the detecting rib 13 ends up passing under the fitting projection 24*a*1 of the contact member 24*a* before the connector locking projection 12 collides with the locking member 23, the connector locking projection 12 can no longer pass under the locking member 23 since the shutter 24 covers the upper part of the locking member 23, thereby making fitting impossible. On the other hand, although it is possible for the detecting rib 13 to pass under the fitting projection 24*a*1 of the contact member 24*a* after the connector locking projection 12 makes contact with the locking member 23, even though the connector locking projection 12 and the locking member 23 are in a fitted state, the detecting rib 13 continues to receive an opposing force while in contact with the shutter 24. For this reason, the window member 22*a* is formed so that the connector locking projection 12 and the detecting rib 13 respectively collide with the locking member 23 and the contact member 24*a* at the same time.

While the shutter 24 is pushed forward by the spring 25, as described above the connector locking projection 12 and the locking member 23 reach a locked state. As a result, the female connector 10 and the male connector 20 do not separate even if an attempt is made to separate them. Consequently, when it becomes necessary to separate them, the pressing-down member 24*b* of the shutter 24 located in the concave recess 21*b* on the upper face of the male connector 20 is pressed down. This results in the shutter 24 being moved backwards, the fitting projection 24a1 of the contact member 24a crossing over the detecting rib 13, and the shutter 24 being retracted from over the upper end of the locking member 23. Accordingly, since the locked state is released, the female connector 10 can then be removed.

In this way, the configuration is such that one of the connectors, the female connector 10, has no moving parts and only the other connector, the male connector 20, has moving parts. This is made possible since the connector locking projections 12 and the detecting ribs 13, which serve as the first colliding member and the second colliding member respectively, are formed immovably on the outer peripheral surface of the female connector 10, which serves as the first connector housing; and since the male connector 20, which serves as the second connector housing, has the hood 22 for allowing the insertion of the female connector 10, and comprises the locking member 23 that fits with the connector locking projection 12, and the shutter 24 that is inserted between the locking member 23 and the hood 22, and which collides against the detecting rib 13, the shutter 24 preventing and allowing the bending of the locking member 23 when the shutter 24 is moved so as to advance and be retracted. In particular, in the case where it is uniformly formed with a casing that houses an electrical appliance, this casing can be configured simply.

Although in the present embodiment the female connector 10 is insertable into the male hood 22, all that is necessary is that one of the two be tubular and the other have a corresponding shape such that it be insertable; there are no particular restrictions regarding the shapes of the other portions. For example, one connector may be arranged to be formed into a shallow box shape in accordance with the arrangement of the terminal insertion chambers; alternatively, ribs for preventing removal may be formed on the inner and outer faces; and so on. Moreover, male terminals and female terminals may be provided on either side. In the case where male terminals are supported in the female connector 10 and female terminals are supported in the male connector 20, since a tubular body protecting each of the female terminals is inserted into the peripheral wall surrounding each male terminal, the configuration can be made water-proof by inserting a rubber seal between the two. Apart from this, there is no need for each connector 10 and 20 to be a unit connector housing; they can, for example, equally be formed so as to have a casing that allow an electrical appliance to be fitted therewith.

We claim:

1. A half-fitting detecting electrical connector assembly comprising a first connector having a housing with an open tubular portion, said tubular portion defining a longitudinal axis, and a second connector engageable with said first connector and having a body insertable within said tubular portion, the body having first and second abutments laterally offset from each other in a direction transverse to said longitudinal axis, and said first connector having a locking member extending in the direction of the longitudinal axis of said tubular portion, the locking member having a resilient latch movable in a direction transverse to said longitudinal axis upon engagement with said first abutment to releasably retain the second connector with the first connector, wherein the first connector has a shutter extending in the direction of the longitudinal axis of the tubular portion and a spring, said shutter being movable against a resilient bias of said spring from an advanced to a retracted position, said shutter being engageable by the second abutment on insertion of the second connector in the tubular portion of the first connector to move said shutter to said retracted position, said shutter permitting said movement of said latch only when said shutter is in the retracted position, and said shutter and said latch being superposed to each other to prevent said movement of said latch when said shutter is in the advanced position.

2. The assembly according to claim 1 wherein the first and second abutments are external.

3. The assembly according to claim 1 wherein said first and second abutments are in a plane perpendicular to the axis of said tubular portion.

4. The assembly according to claim 2 wherein said first and second abutments are in a plane perpendicular to the axis of said tubular portion.

5. The assembly of any claim 1 wherein said shutter includes a contact member, the second abutment engages a proximal side of the contact member of the shutter to move said shutter to the retracted position on insertion of the second connector in the first connector, and the contact member being resiliently displaceable in the retracted position of said shutter to permit passage of said second abutment from the proximal side of said contact member to an opposite distal side of the contact member.

6. The assembly of claim 5 wherein the housing has a recess to receive the contact member in the retracted position.

7. The assembly of claim 1 wherein the shutter has an external projection for movement thereof.

8. The assembly of claim 2 wherein the shutter has an external projection for movement thereof.

9. The assembly of claim 1 and further including a helical spring acting to provide the resilient bias between said shutter and the housing.

10. The assembly of claim 8 and further including a helical spring acting to provide the resilient bias between the shutter and the housing.

11. The assembly of claim 9 wherein the helical spring acts in compression.

12. The assembly of claim 1 wherein said latch comprises a resilient arm having an aperture, the arm being displaceable on contact with said first abutment, and said first abutment being a snap-fit in said aperture.

13. The assembly of claim 12 wherein said shutter includes a recess to receive said resilient arm in the retracted position.

14. The assembly of claim 13 wherein the shutter is substantially planar and said recess comprises a cut-away portion of said shutter.

15. The assembly of claim 1 wherein said housing includes an open ended external trough to receive said shutter, and a cap to close the open end of said trough, the cap defining the retracted position of said shutter by abutment therewith.

16. The assembly of claim 15 wherein said cap is detachable from said housing and further includes an abutment for said resilient bias of the shutter.

17. The assembly of claim 16 wherein said cap includes guide arms for engagement in corresponding slots of said shutter, the guide arms being aligned with the axis of said tubular portion and preventing lateral movement of said shutter.

* * * * *